US007077690B2

(12) United States Patent
Zhang et al.

(10) Patent No.: US 7,077,690 B2
(45) Date of Patent: Jul. 18, 2006

(54) ELECTRICAL CONNECTOR WITH IMPROVED SLIDER MEMBER

(75) Inventors: Chi Zhang, Kunsan (CN); BaoZeng Wang, Kunsan (CN); XinLian Chen, Kunsan (CN)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 10/991,884

(22) Filed: Nov. 17, 2004

(65) Prior Publication Data

US 2005/0124210 A1 Jun. 9, 2005

(30) Foreign Application Priority Data

Nov. 19, 2003 (CN) ..... 2003 2 01198233

(51) Int. Cl.
*H01R 12/24* (2006.01)

(52) U.S. Cl. ..... 439/495

(58) Field of Classification Search ..... 439/495, 439/496, 484, 476.1

See application file for complete search history.

(56) References Cited

U.S. PATENT DOCUMENTS

| | | | | |
|---|---|---|---|---|
| 4,969,838 | A * | 11/1990 | Himes et al. | 439/484 |
| 5,370,552 | A * | 12/1994 | Chishima et al. | 439/495 |
| 5,549,485 | A * | 8/1996 | Chishima et al. | 439/495 |
| 6,371,797 | B1 * | 4/2002 | Kikuchi et al. | 439/496 |
| 6,551,128 | B1 * | 4/2003 | Asai | 439/495 |

FOREIGN PATENT DOCUMENTS

JP D 1108294 3/2001

* cited by examiner

*Primary Examiner*—Briggitte R. Hammond

(57) ABSTRACT

An electrical connector (100) is provided for connecting a flexible printed circuit or a flexible flat cable. The connector comprises a housing (1), a number of the electrical contacts (2) received in the housing and a slider member (3) movably mounted to the housing. The housing includes a mating surface (111) and a pair of arm receptacles (13). The slider member has a flat plate (30), a pressing portion (31) perpendicular to the plate and a pair of latching arms (32) extending from the plate. The plate defines a first opening (302) and a second opening (301). Each of the latching arms is wedge-shaped and has a latch (323) for engaging with the corresponding arm receptacles.

2 Claims, 4 Drawing Sheets

ELECTRICAL CONNECTOR WITH IMPROVED SLIDER MEMBER

BACKGROUND OF THE INVENTION

1. Field of the Invention

The present invention is generally related to the art of electrical connectors, and more particularly, to an electrical connector which is used to connect a flexible printed circuit or a flexible flat cable with a printed circuit board.

2. Description of Related Art

A variety of flexible printed circuit connectors are widely used in electronic devices such as mobile phones, keyboards and fax machines. These flexible printed circuit connectors are provided for connecting flexible printed circuits with printed circuit boards. A conventional flexible printed circuit connector generally comprises an insulated housing, a plurality of electrical contacts received in the housing and a slider member movably mounted to the housing. When a flexible printed circuit is mounted into the housing, the slider member presses the flexible printed circuit against the electrical contacts firmly to achieve a reliable electrical connection therebetween.

U.S. Pat. No. 6,371,797 discloses a flexible printed circuit connector. FIG. 1 of U.S. Pat. No. 6,371,797 shows that a housing of the flexible printed circuit connector comprises a pair of arm receptacles extending from lateral ends thereof. Each of the arm receptacles defines a slot therein. A slider member includes a plate and a pair of latching arms formed on lateral ends of the plate. When the flexible printed circuit is not mounted to the housing, an inserting mouth is provided between the slider member and the housing, so the latching arms can move around in the arm receptacles freely. After the flexible printed circuit is mounted to the housing, the slider member presses the flexible printed circuit against electrical contacts firmly. Accordingly, a complete electrical connection between the flexible printed circuit and the flexible printed circuit connector is established. However, with the trend toward miniaturization of electronic devices, the width of the latching arms is relatively small, and the latching arms are not adequately intense to endure the force applied thereon by repeatedly inserting into and pulling out of the housing. Therefore, the latching arms are easily damaged in operation or other applications especially in sections thereof at which the latching arms are connected with the plate.

Hence, an improved flexible printed circuit connector is highly desired to overcome the aforementioned disadvantages of the prior art.

SUMMARY OF THE INVENTION

Accordingly, an object of the present invention is to provide a flexible printed circuit connector, which can provide adequate intensity to a slider member thereof.

In order to achieve the object set forth, an improved flexible printed circuit connector is provided. The flexible printed circuit connector comprises an insulated housing, a plurality of electrical contacts received in the housing and a slider member movably mounted to the housing. The housing comprises a mating surface and a pair of arm receptacles extending from lateral ends of the housing. The slider member comprises a flat plate, a pressing portion perpendicular to the flat plate and a pair of latching arms extending from lateral ends of the flat plate and lockable with the corresponding arm receptacles. Each of the latching arms is in wedge-shaped and has a latch at an end thereof for locking with corresponding arm receptacles.

Other objects, advantages and novel features of the present invention will be drawn from the following detailed description of a preferred embodiment of the present invention with attached drawings.

DETAILED DESCRIPTION OF THE INVENTION

Reference will now be made in detail to the preferred embodiment of the present invention.

Figure 1:
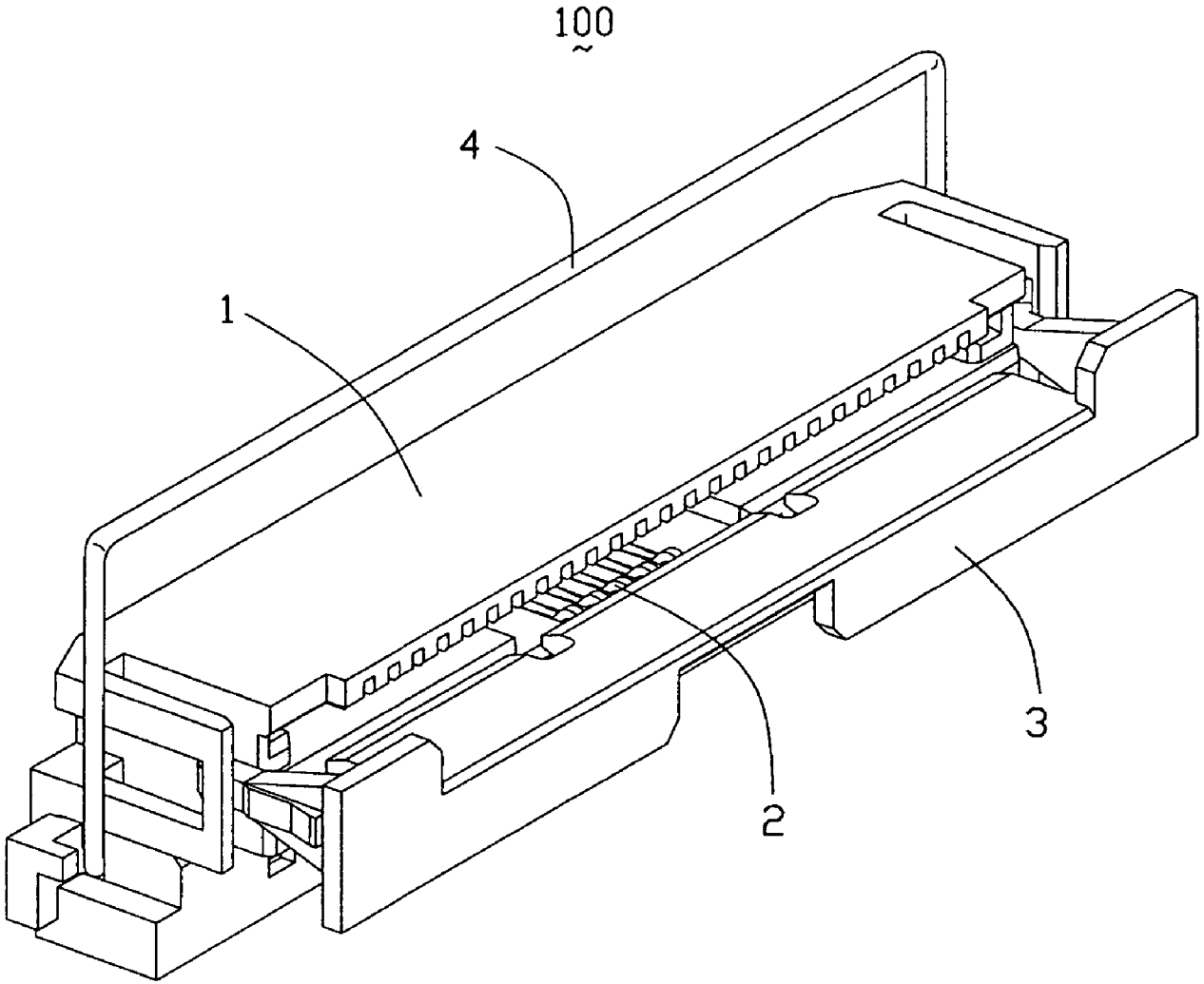
FIG. 1 is an assembled, perspective view of a flexible printed circuit connector in accordance with the present invention without a flexible printed circuit.

Referring to FIG. 1, an electrical connector 100 in accordance with the present invention comprises an insulated housing 1, a plurality of electrical contacts 2 received in the housing 1, a flexible printed circuit 5 (shown in FIG. 4), a slider member 3 movably mounted to the housing 1 and a pulling member 4.

Figure 2:
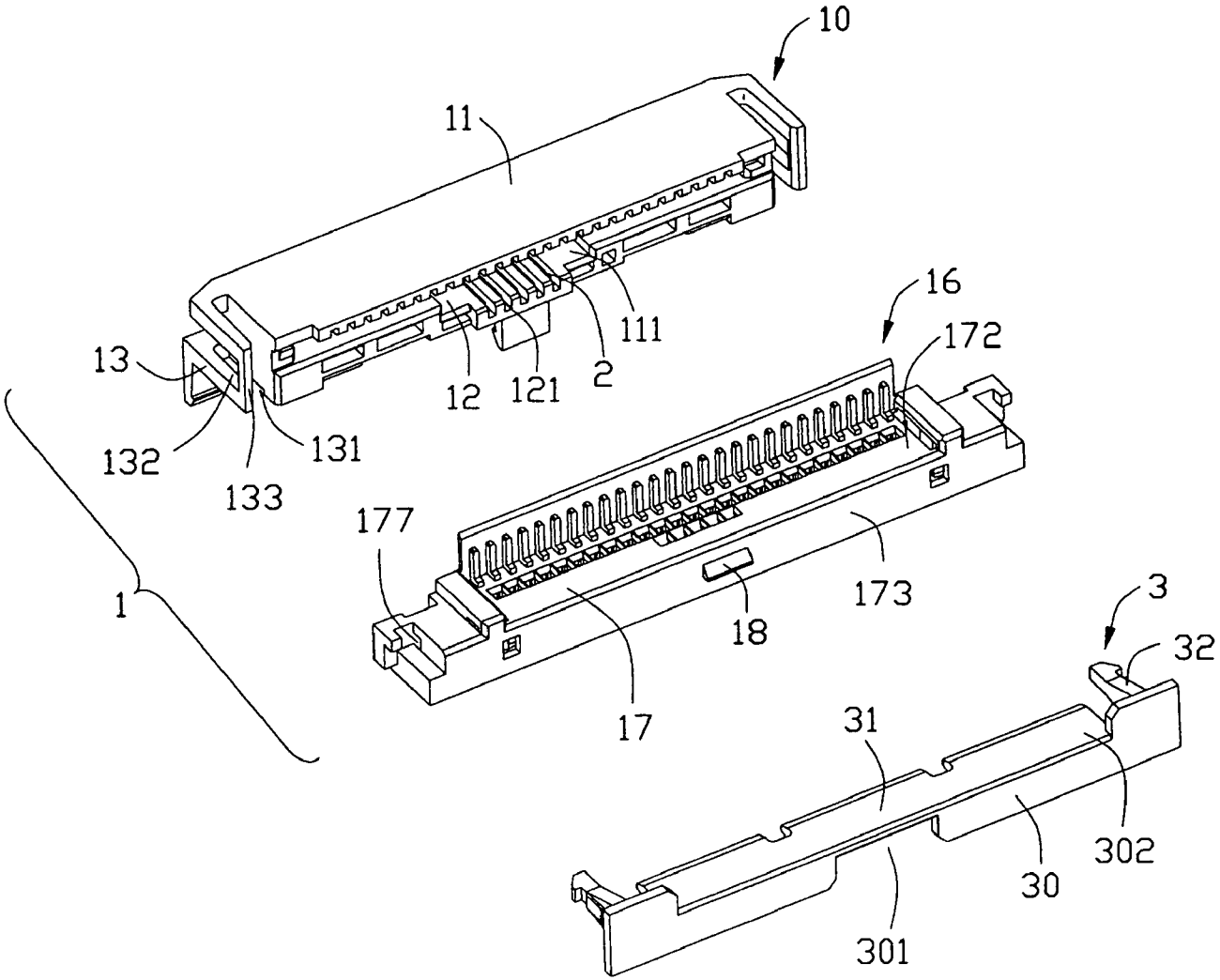
FIG. 2 is an exploded, perspective view of a housing and a slider member of the flexible printed circuit connector of FIG. 1.
Figure 3:
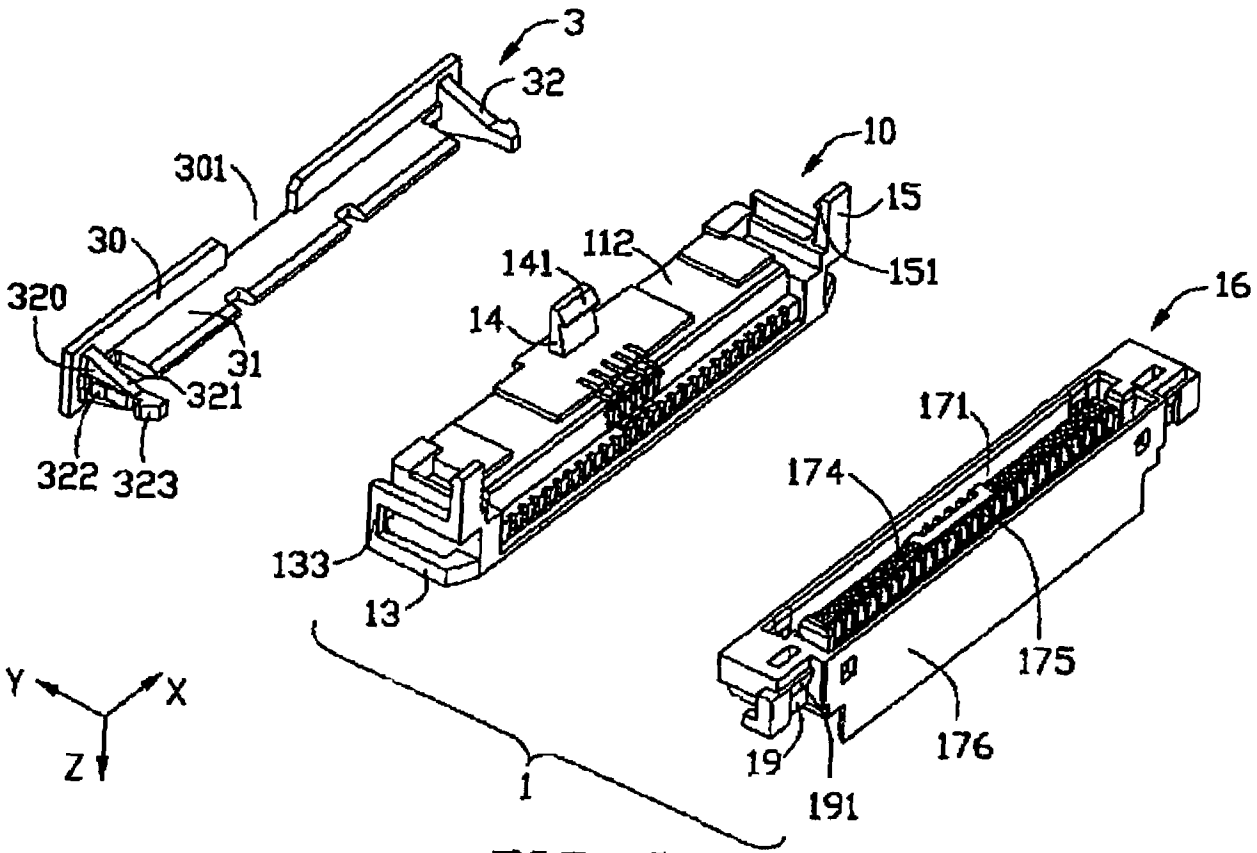
FIG. 3 is a view similar to FIG. 2, but taken from another angle.

Referring to FIGS. 2 and 3, the insulated housing 1 comprises a first housing portion 10 or an upper housing and a second housing portion 16 or a lower housing. The first housing portion 10 comprises a rectangular base portion 11 which includes a mating surface 111 extending along a lateral direction (marked by coordinate X) and a first mounting surface 112 adjoining the mating surface 111. A receiving space 12 is formed in the mating surface 111, and the upper and lower walls of the receiving space 12 respectively define a plurality of receiving channels 121 which cooperate with the second housing 16 to secure the electrical contacts 2 therein. Moreover, the number of the receiving channels 121 is determined variably with the width of the flexible printed circuit 5. A pair of arm receptacles 13 are formed on lateral ends of the base portion 11 of the first housing portion 10 in the lateral direction. Each of the arm receptacles 13 extends outwardly and forwardly from lateral ends of a rear portion of the base portion 11 and is parallel to the receiving channels 121. A gap 131 is formed between the base portion 11 and each of the arm receptacles 13. Each of the arm receptacles 13 defines a slot 132 extending through one end thereof, and the other end of the arm receptacle 13 is served as a stop portion 133. A first latch portion 14 extends from the first mounting surface 112 and has a first latch 141. A pair of second latch portions 15 are opposite to the first latch portion 14 and extend from the first mounting surface 112. Each of the second latch portions 15 has a second latch 151.

The second housing portion 16 comprises a rectangular base 17 including a bottom surface 171, a second mounting surface 172 opposite to the bottom surface 171, a front surface 173 connecting the bottom surface 171 with the second mounting surface 172 and a rear surface 176 opposite to the front surface 173. A cavity (not labeled) is recessed from the bottom surface 171. A tongue portion 174 extends upwardly from the bottom of the cavity and defines a plurality of receiving grooves 175 at both sidewalls thereof for securing electrical contacts. The front surface 173 has a protrusion 18 for engaging with the first latch 141 of the first latch portion 14. A stop plate (not labeled) extends from the rear surface 176 and away from the bottom surface 171. A pair of recesses 19 are formed on a rear portion of the base 17 and are in communication with outer space. A rib 191 is formed on a surface of the recess 19 parallel to the rear surface 176 for locking with the corresponding second latch 151 of the second latch portion 15. The base 17 defines a retaining hole 177 respectively at lateral ends thereof for retaining the pulling member 4.

The slider member 3 has a fiat plate 30, a pressing portion 31 extending forward from and perpendicular to the plate 30 in a front-to-back direction (marked by coordinate Y) and a pair of latching arms 32 formed on lateral ends of the plate 30 in the lateral direction and extending along the same direction as the pressing portion 31. The plate 30 defines a first opening 302 and a second opening 301. The widths of the first opening 302 and the second opening 301 are respectively determined variably with the corresponding number and widths of the receiving channels 121 defined in the upper and lower sidewalls of the receiving space 12 of the first housing portion 10 for receiving a variety of the flexible printed circuits or flexible flat cables which have different widths. Each of the latching arms 32 comprises a pair of side surfaces 320 and an upper and a lower surfaces 321 which gradually incline toward each other so as to make the latching arms 32 in wedge-shaped. Thus, a root portion (not labeled) of each latching arm 32 joined with the plate 30 has a larger dimension than a distal end thereof in a vertical direction (marked by coordinate Z) perpendicular to the lateral direction and the front-to-back direction. In such a way, the latching arms 32 are strong enough on the root portions to prevent them from breaking from the plate 30, while are slim enough at the distal ends thereof to permit them move freely in the slots 132 and the gaps 131. Additionally, each latching arm 32 further comprises a projection 322 and a latch 323 extending outward from the side surface 320, and the projection 322 is arranged adjacent to the root portion while the latch 323 is arranged adjacent to the distal end.

Figure 4:
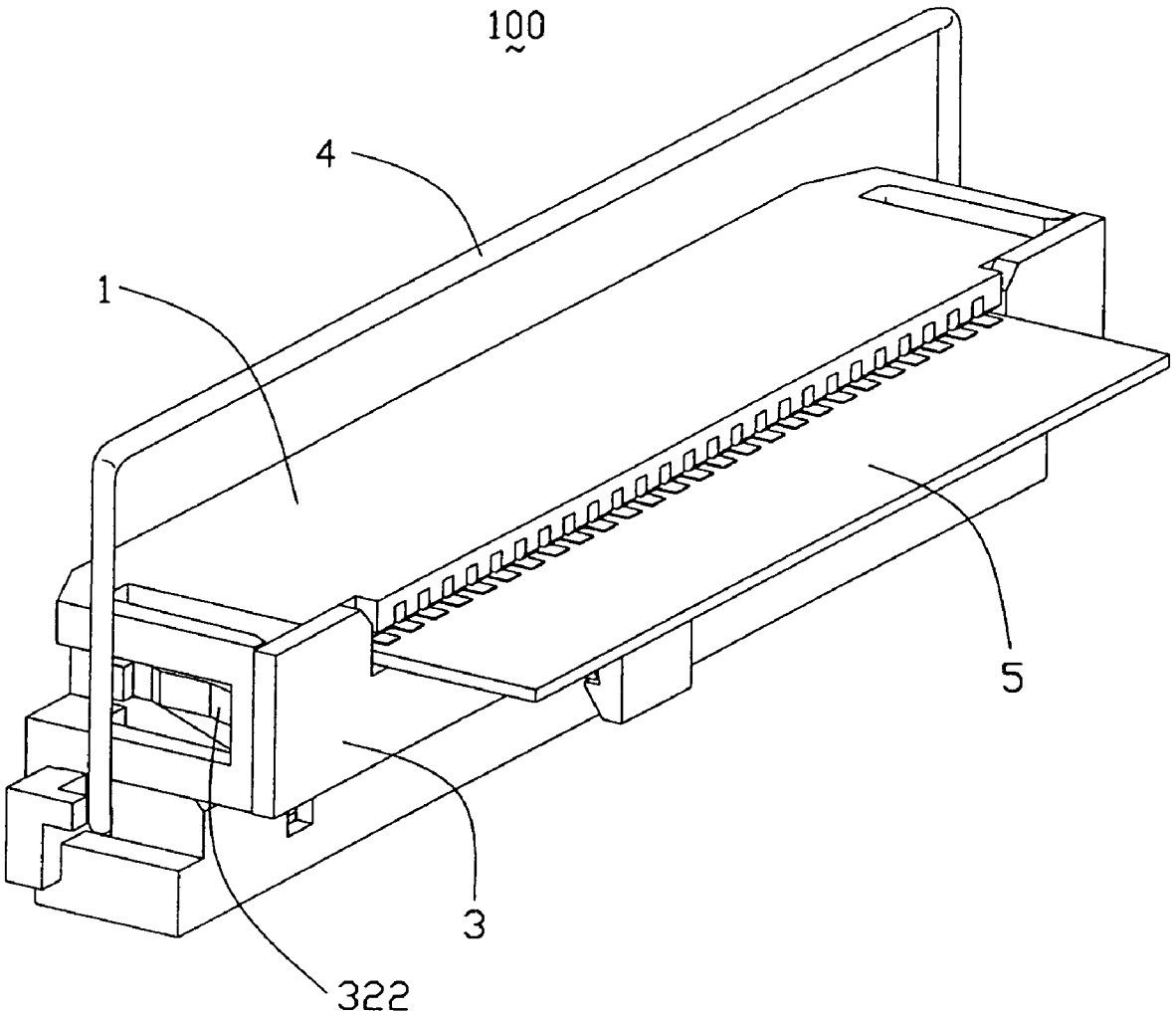
FIG. 4 is a completely assembled, perspective view of the flexible printed circuit connector in accordance with the present invention.

Referring to FIG. 1 in conjunction with FIG. 2 to FIG. 4, when not assembling the flexible printed circuit 5 into the electrical connector 100, the slider member 3 can move around in the gap 131 and the slot 132, that is, the slider member 3 is in an open position. Furthermore, the latches 323 of the latching arms 32 lock with the stop portion 133, so the latching arms 32 cannot break off the housing 1, meanwhile, an inserting mouth is formed between the housing 1 and a slider member 3.

Referring to FIG. 4 in conjunction with FIG. 2 and FIG. 3, the flexible printed circuit is mounted to the inserting mouth by zero insert force, then the slider member 3 is pressed into the receiving space 12 of the housing 1. When the projections 322 of the latching arms 32 lock with the stop portions 133 of the arm receptacles 13, the pressing portion 31 of the slider member 3 presses the flexible printed circuit 5 to connect with the electrical contacts 2 firmly, the slider member 3 is in a closed position. Consequently, a complete circuit is established between the flexible printed circuit 5 and the connector 100.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An electrical connector for connecting a flexible printed circuit comprising:

a housing comprising a mating surface and a pair of arm receptacles at lateral ends thereof in a lateral direction;

a plurality of electrical contacts received in the housing; and a slider member being movably mounted to the housing in a front-to-back direction perpendicular to said lateral direction, and comprising a plate, a pressing portion extending forwardly from the plate and a pair of latching arms extending forwardly from lateral ends of the plate, each of the latching arms defining a root portion jointed with the plate; wherein said root portion has a larger dimension than other portions of each latching arm in a vertical direction perpendicular to said front-to-back direction and said lateral direction; wherein said housing comprises a first housing and a second housing vertically assembled to each other and cooperatively retaining each electrical contact therein; wherein the first housing comprises a base portion having the mating surface and a first mounting surface, and a first latch portion formed on one side of the first mounting surface, and wherein the second housing comprises a second mounting surface, a bottom surface opposite to the second mounting surface, a front surface and a protrusion projecting from the front surface for engaging with the first latch portion.

2. The electrical connector as described claim 1, wherein a pair of second latch portions are formed at lateral ends of the other side of the first mounting surface, and the second housing has a pair of ribs engaging with the pair of second latch portions.

* * * * *